US009683536B2

(12) United States Patent
Fulton

(10) Patent No.: US 9,683,536 B2
(45) Date of Patent: Jun. 20, 2017

(54) ENHANCED GLOW PLUG CONTROL

(71) Applicant: Ford Global Technologies, LLC, Dearborn, MI (US)

(72) Inventor: Brien Lloyd Fulton, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 503 days.

(21) Appl. No.: 13/895,544

(22) Filed: May 16, 2013

(65) Prior Publication Data

US 2014/0338625 A1 Nov. 20, 2014

(51) Int. Cl.
*F02P 19/02* (2006.01)
*F23Q 7/00* (2006.01)

(52) U.S. Cl.
CPC ..... *F02P 19/021* (2013.01); *F02P 19/027* (2013.01); *F23Q 7/001* (2013.01)

(58) Field of Classification Search
CPC ..... F02P 19/021; F02P 19/025; F02P 19/027; F23Q 7/001; F23Q 2007/002; F23Q 2007/008; F23Q 7/22; F23Q 7/24
USPC ..... 123/145 A, 169 R, 179.6; 219/260
See application file for complete search history.

(56) References Cited

U.S. PATENT DOCUMENTS 4,458,639 A * 7/1984 Abe et al. ..... 123/179.21
4,624,226 A * 11/1986 Klak et al. ..... 123/179.21
5,146,881 A * 9/1992 Pfefferle ..... 123/145 A
5,241,929 A * 9/1993 Grassi et al. ..... 123/145 A
6,148,258 A 11/2000 Boisvert et al.
6,420,793 B1 * 7/2002 Gale et al. ..... 290/34
6,772,623 B2 8/2004 Harness et al.
7,711,498 B2 5/2010 Hiramatsu
2003/0037747 A1 * 2/2003 Streng ..... 123/179.3
2006/0289425 A1 * 12/2006 Serra et al. ..... 219/270
2007/0135987 A1 6/2007 Coffey et al.
2010/0280735 A1 11/2010 Moritz et al.
2011/0000901 A1 1/2011 Bauer et al.
2011/0118964 A1 5/2011 Tanaka et al.
2011/0127250 A1 * 6/2011 Rapp et al. ..... 219/260
(Continued)

FOREIGN PATENT DOCUMENTS

CN 101956640 A 1/2011
EP 2314863 A1 4/2011
JP 2009047134 A 3/2009

OTHER PUBLICATIONS

Fulton, Brien Lloyd, "Enhanced Glow Plug Control," U.S. Appl. No. 13/895,583, filed May 16, 2013, 38 pages.
(Continued)

*Primary Examiner* — Jacob Amick
(74) *Attorney, Agent, or Firm* — Julia Voutyras; McCoy Russell LLP

(57) ABSTRACT

Methods for controlling a glow plug temperature in a diesel engine are herein described. In one example, a controller may adjust a first phase voltage coupled to the glow plug in relation to a parameter associated with engine start time, and couple a lower second phase voltage to the glow plug in order to control the cylinder temperature and thereby the engine start time. In one particular example, the reduced second phase voltage allows the operating cycle push phase to be extended, which increases glow plug durability and further allows for the useful life of the glow plug to be extended.

19 Claims, 10 Drawing Sheets

(56) References Cited

U.S. PATENT DOCUMENTS

| | | | | |
|---|---|---|---|---|
| 2011/0202260 | A1 | 8/2011 | Cunningham et al. | |
| 2011/0246045 | A1* | 10/2011 | Cassani | 701/102 |
| 2011/0303650 | A1* | 12/2011 | Sakurai | F02P 19/025 219/263 |
| 2012/0138033 | A1 | 6/2012 | Kurtz et al. | |
| 2013/0087114 | A1* | 4/2013 | Joos | F02P 19/02 123/179.21 |
| 2014/0338625 | A1* | 11/2014 | Fulton | 123/145 A |

OTHER PUBLICATIONS

Partial Translation of Office Action of Chinese Patent Application No. 201410205380.2, Issued Feb. 27, 2017, State Intellectual Property Office of PRC, 10 pages.

Partial Translation of Office Action of Chinese Patent Application No. 201410205368.1, Issued Feb. 27, 2017, State Intellectual Property Office of PRC, 10 pages.

* cited by examiner

402

SECOND (GLOW) PHASE TEMPERATURE TABLE

| POST GLOW TIME (S) | ENGINE TEMPERATURE (°C) | | | | | | | | |
|---|---|---|---|---|---|---|---|---|---|
| | -30 | -20 | -15 | -5 | 0 | 20 | 40 | 60 | 80 |
| 0 | 1200 | 1150 | 1125 | 1075 | 1005 | 985 | 965 | 945 | 0 |
| 30 | 1200 | 1150 | 1125 | 1075 | 1005 | 985 | 965 | 945 | 0 |
| 60 | 1050 | 1050 | 1050 | 1025 | 1005 | 985 | 965 | 945 | 0 |
| 90 | 1050 | 1050 | 1050 | 1025 | 1005 | 985 | 965 | 945 | 0 |
| 120 | 1050 | 1050 | 1050 | 1025 | 995 | 985 | 960 | 935 | 0 |
| 180 | 1050 | 1050 | 1050 | 1025 | 985 | 970 | 960 | 935 | 0 |
| 240 | 1050 | 1050 | 1050 | 1025 | 0 | 0 | 0 | 0 | 0 |
| 300 | 1025 | 1025 | 1025 | 1025 | 0 | 0 | 0 | 0 | 0 |
| 480 | 1025 | 1025 | 1025 | 1025 | 0 | 0 | 0 | 0 | 0 |

404

FIRST (PUSH) PHASE VOLTAGE

| GLOW PHASE TEMP. (°C) | 1200 | 1100 | 1050 | 1000 | 900 | 800 | 700 | 600 | 500 |
|---|---|---|---|---|---|---|---|---|---|
| PUSH PHASE VOLTAGE (V) | 8 | 9 | 11 | 11 | 11 | 11 | 11 | 11 | 11 |

406

WAIT TO START TIME LAMP

| PUSH PHASE VOLTAGE (V) | 7 | 8 | 9 | 10 | 11 | 11 | 11 | 11 | 11 |
|---|---|---|---|---|---|---|---|---|---|
| WAIT TO START TIME (S) | 5 | 3.5 | 3 | 2.5 | 2 | 2 | 2 | 2 | 2 |

FIG. 4A

412

SECOND (GLOW) PHASE VOLTAGE TABLE

| POST GLOW TIME (S) | ENGINE TEMPERATURE (°C) -30 | -20 | -15 | -5 | 0 | 20 | 40 | 60 | 80 |
|---|---|---|---|---|---|---|---|---|---|
| 0 | 7 | 6.5 | 6 | 5.6 | 5 | 5 | 4 | 4 | 0 |
| 30 | 7 | 6.5 | 6 | 5.6 | 5 | 5 | 4 | 4 | 0 |
| 60 | 5.6 | 5.6 | 5.6 | 5 | 5 | 5 | 4 | 4 | 0 |
| 90 | 5.6 | 5.6 | 5.6 | 5 | 5 | 5 | 4 | 4 | 0 |
| 120 | 5.6 | 5.6 | 5.6 | 5 | 5 | 5 | 4 | 4 | 0 |
| 180 | 5 | 5 | 5 | 5 | 5 | 5 | 4 | 4 | 0 |
| 240 | 5 | 5 | 5 | 5 | 0 | 0 | 0 | 0 | 0 |
| 300 | 5 | 5 | 5 | 5 | 0 | 0 | 0 | 0 | 0 |
| 480 | 5 | 5 | 5 | 5 | 0 | 0 | 0 | 0 | 0 |

404

FIRST (PUSH) PHASE VOLTAGE

| GLOW PHASE TEMP. (°C) | 1200 | 1100 | 1050 | 1000 | 900 | 800 | 700 | 600 | 500 |
|---|---|---|---|---|---|---|---|---|---|
| PUSH PHASE VOLTAGE (V) | 8 | 9 | 11 | 11 | 11 | 11 | 11 | 11 | 11 |

406

WAIT TO START TIME LAMP

| PUSH PHASE VOLTAGE (V) | 7 | 8 | 9 | 10 | 11 | 11 | 11 | 11 | 11 |
|---|---|---|---|---|---|---|---|---|---|
| WAIT TO START TIME (S) | 5 | 3.5 | 3 | 2.5 | 2 | 2 | 2 | 2 | 2 |

FIG. 4B

422

FIRST (PUSH) PHASE VOLTAGE

| ENGINE TEMP. (°C) | -30 | -20 | -15 | -5 | 0 | 20 | 40 | 60 | 80 |
|---|---|---|---|---|---|---|---|---|---|
| PUSH PHASE VOLTAGE (V) | 8 | 9 | 10 | 11 | 11 | 11 | 11 | 11 | 11 |

406

WAIT TO START TIME LAMP

| PUSH PHASE VOLTAGE (V) | 7 | 8 | 9 | 10 | 11 | 11 | 11 | 11 | 11 |
|---|---|---|---|---|---|---|---|---|---|
| WAIT TO START TIME (S) | 5 | 3.5 | 3 | 2.5 | 2 | 2 | 2 | 2 | 2 |

FIG. 4C

ENHANCED GLOW PLUG CONTROL

FIELD

The field of the invention relates to glow plugs for diesel engines.

BACKGROUND AND SUMMARY

Diesel engines utilize compression ignition and an electrically heated glow plug to assist in starting, especially in cold weather conditions. Typically, a voltage is applied to the glow plug for a predetermined time to assist with compression starting by providing a hot spot near the fuel injector spray plume. To reduce the wait time for the glow plug to heat up to a temperature conducive for combustion to start an engine, a fixed higher voltage may be initially applied for a fixed time to reach a target temperature and then reduced to a fixed lower voltage to maintain the temperature.

The inventor herein has recognized that applying the higher voltage, typically 11 volts, even for a short time reduces glow plug life. This is especially true in the case of metallic, rather than ceramic, glow plugs. And, using lower voltages may result in unacceptably long start times. The inventor has solved these problems by controlling a first phase voltage having an amplitude related to a parameter associated with engine start time, and coupling a lower second phase voltage to the glow plug after the first phase voltage. In another aspect of the solution, the parameter is selected from one or more of the following: expected temperature of the glow plug during the second phase voltage, or the second phase voltage; or engine temperature. In yet another aspect of the solution, the time indicated for starting the engine, may also be related to these parameters.

The above advantages and other advantages, and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where:

FIGS. 4A-C show example look-up tables based on various engine parameters;

DETAILED DESCRIPTION

Figure 1:
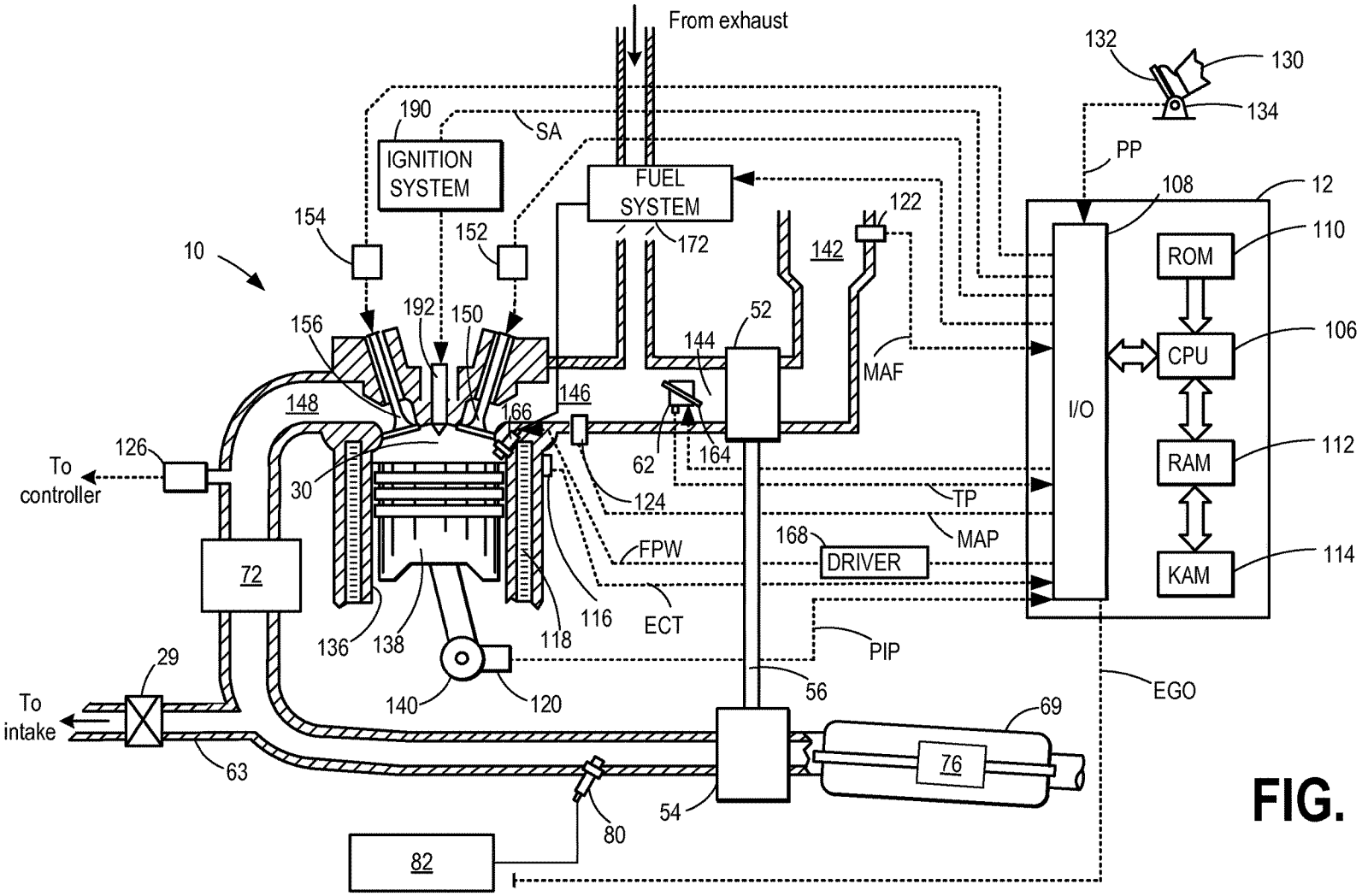
FIG. 1 shows a partial engine view.
Figure 2:
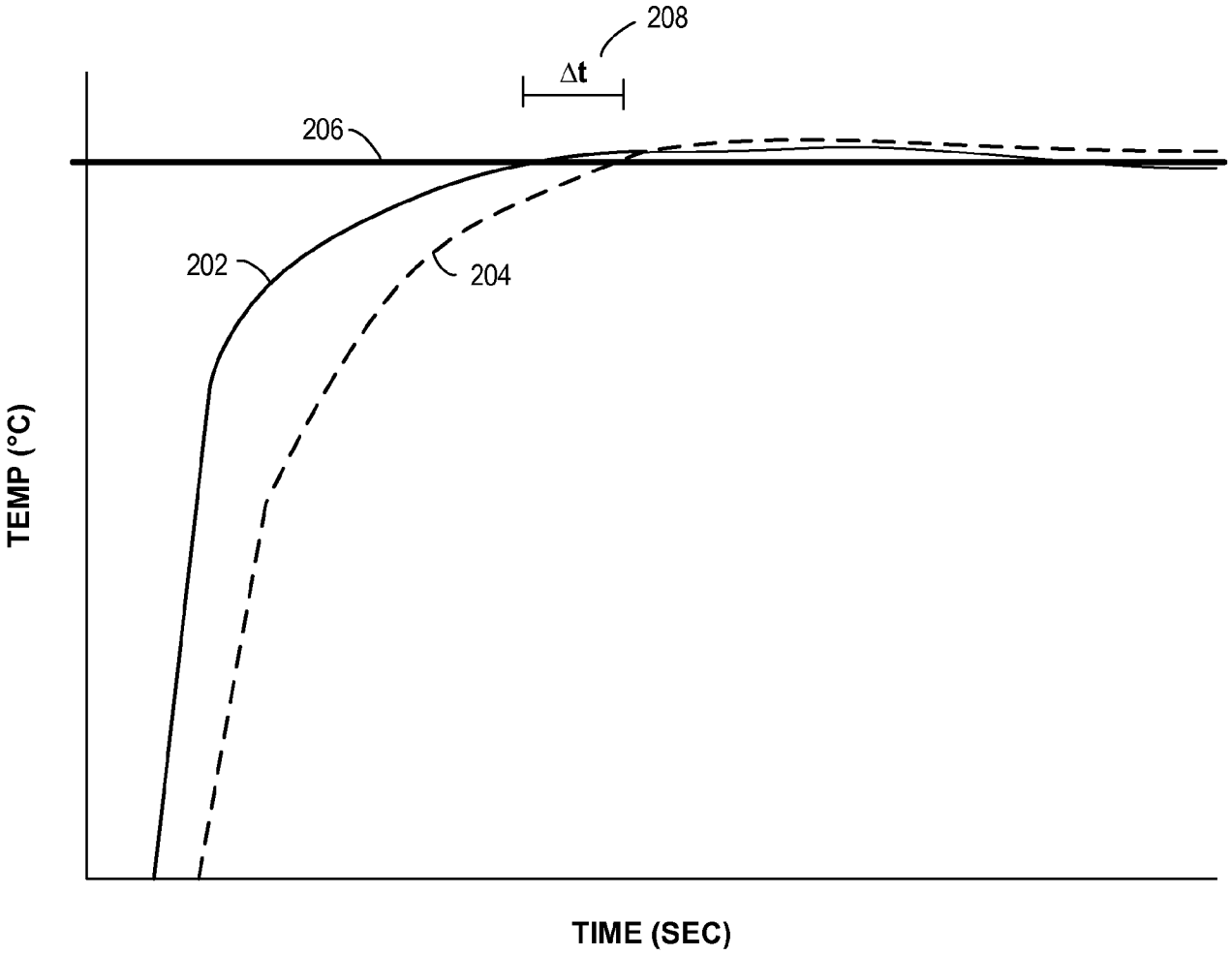
FIG. 2 shows example schematic glow plug temperature profiles for two different applied voltages.
Figure 3A:
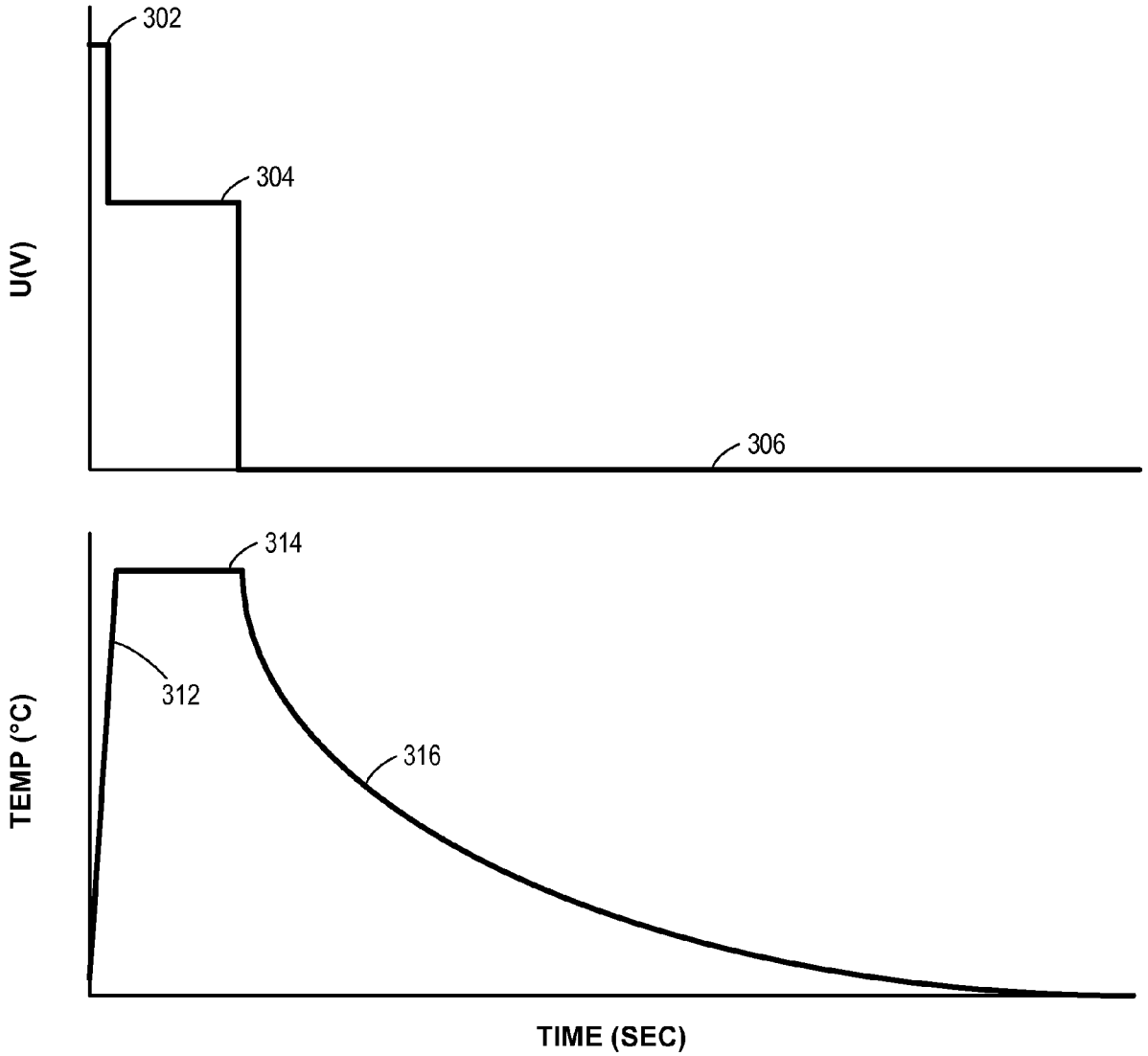
FIGS. 3A-B show example schematic glow plug heating profiles according to the present disclosure.
Figure 3B:
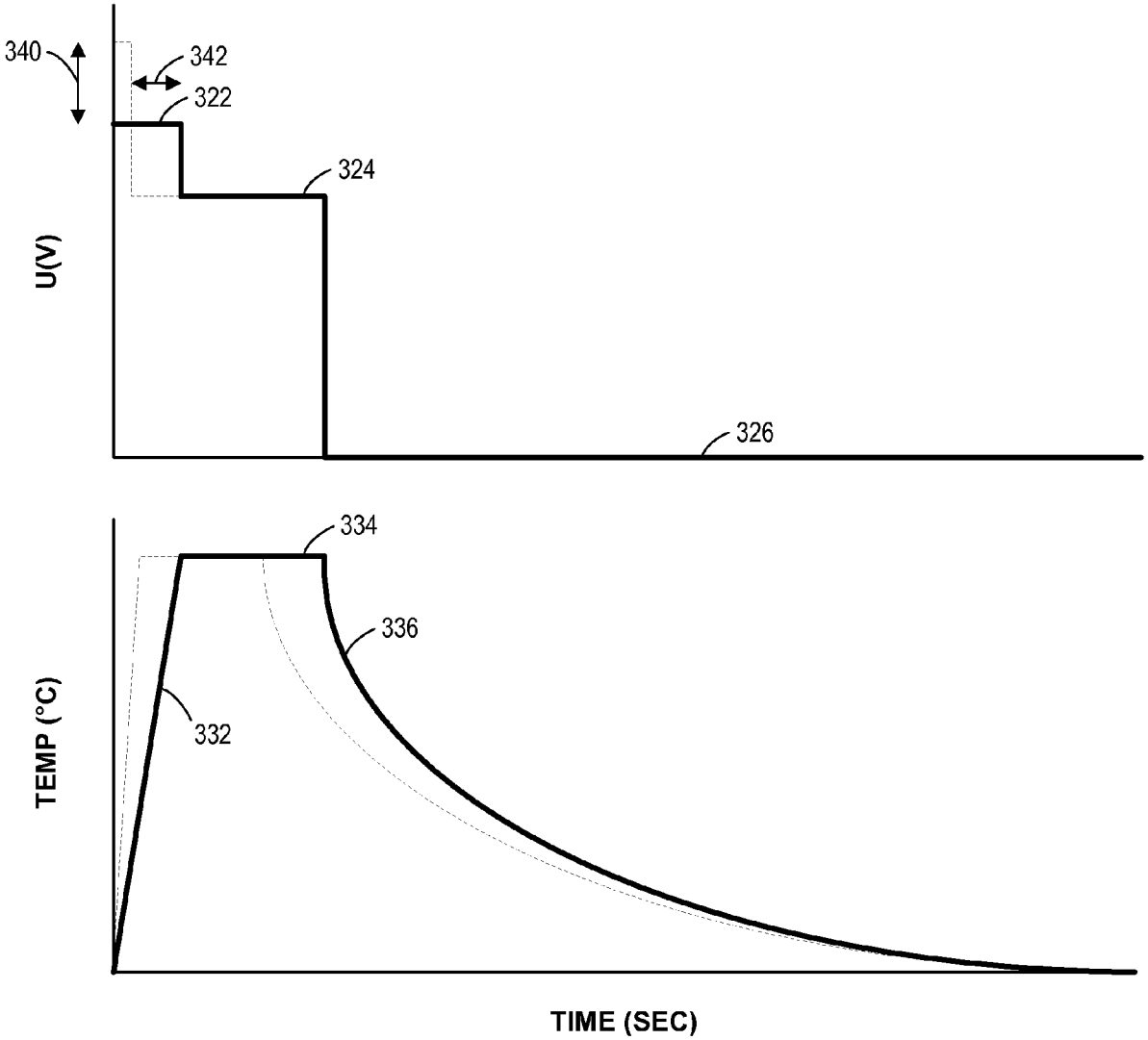
Figure 5:
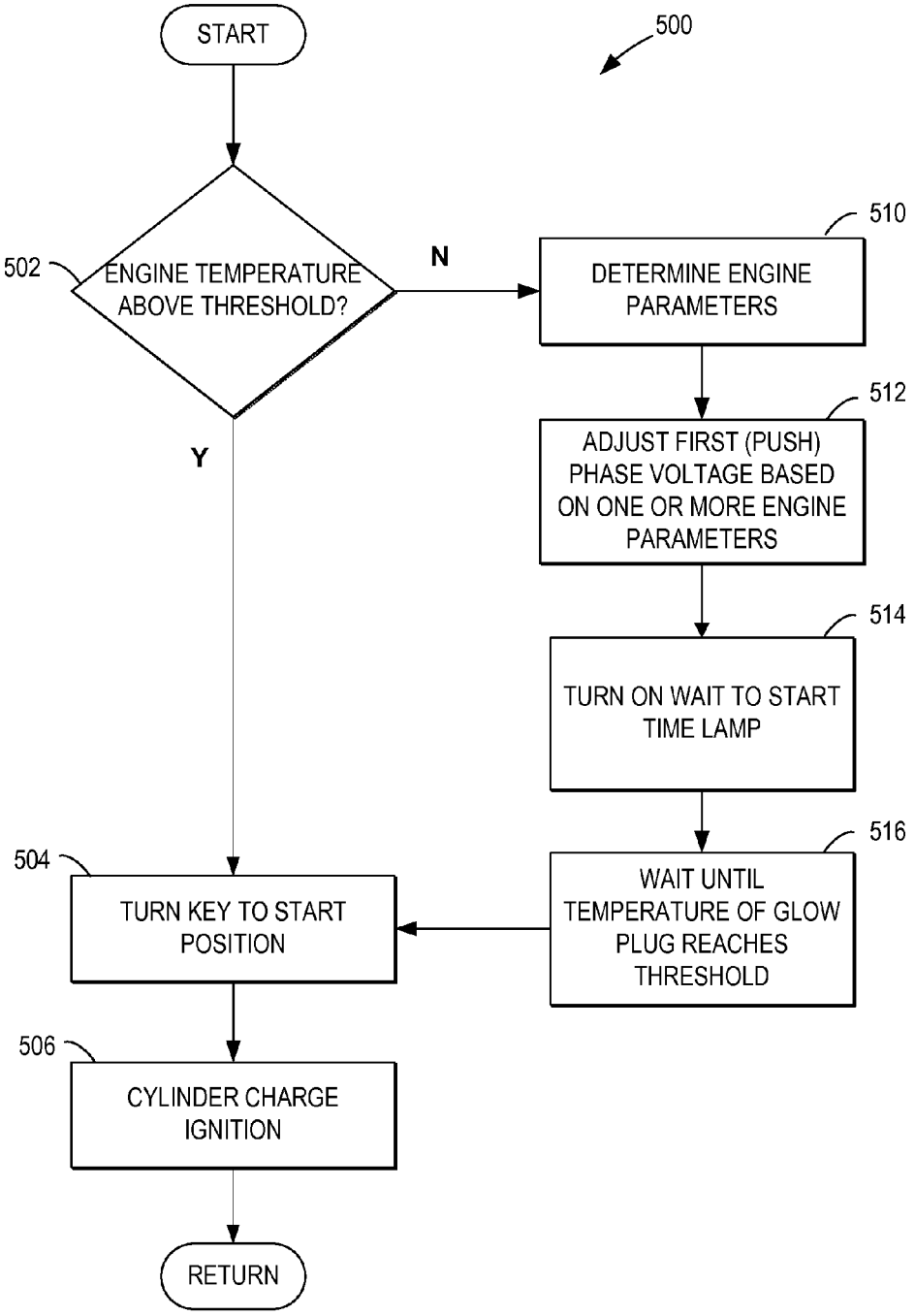
FIG. 5 is a flow-chart illustrating a first example method to determine the first phase voltage based on an engine operating parameter.
Figure 6:
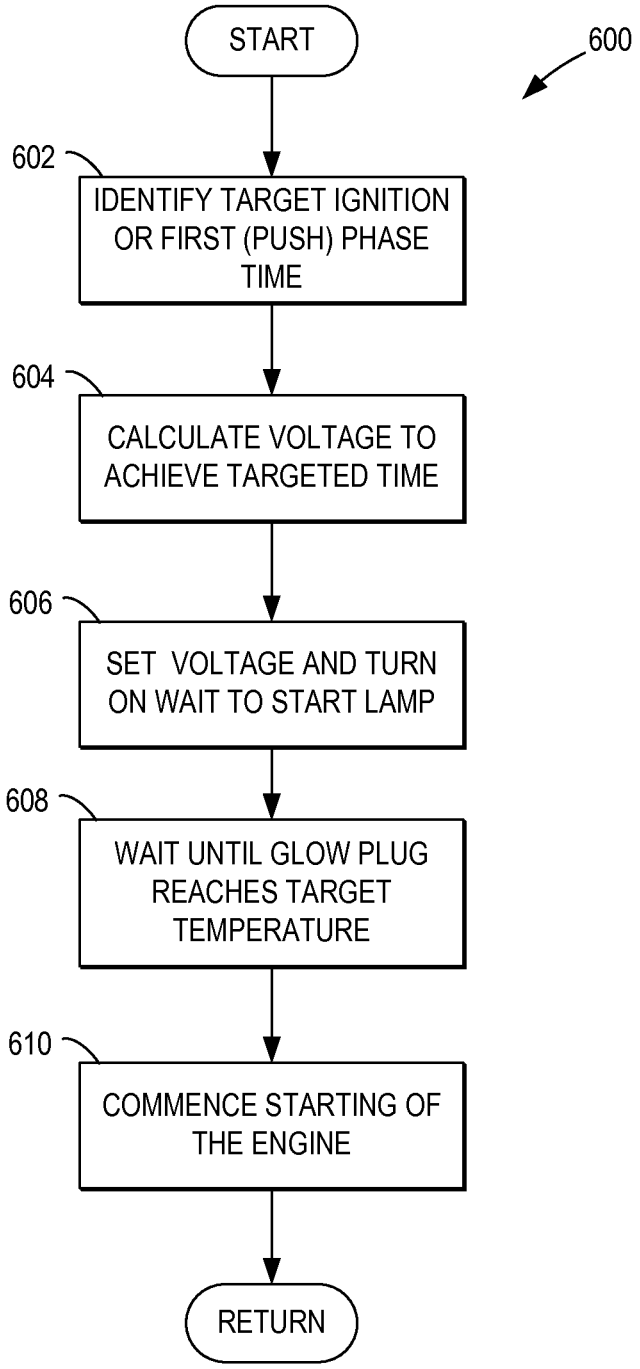
FIG. 6 is a flow-chart illustrating a second example method to calculate a first phase voltage based on a targeted start time.
Figure 7:
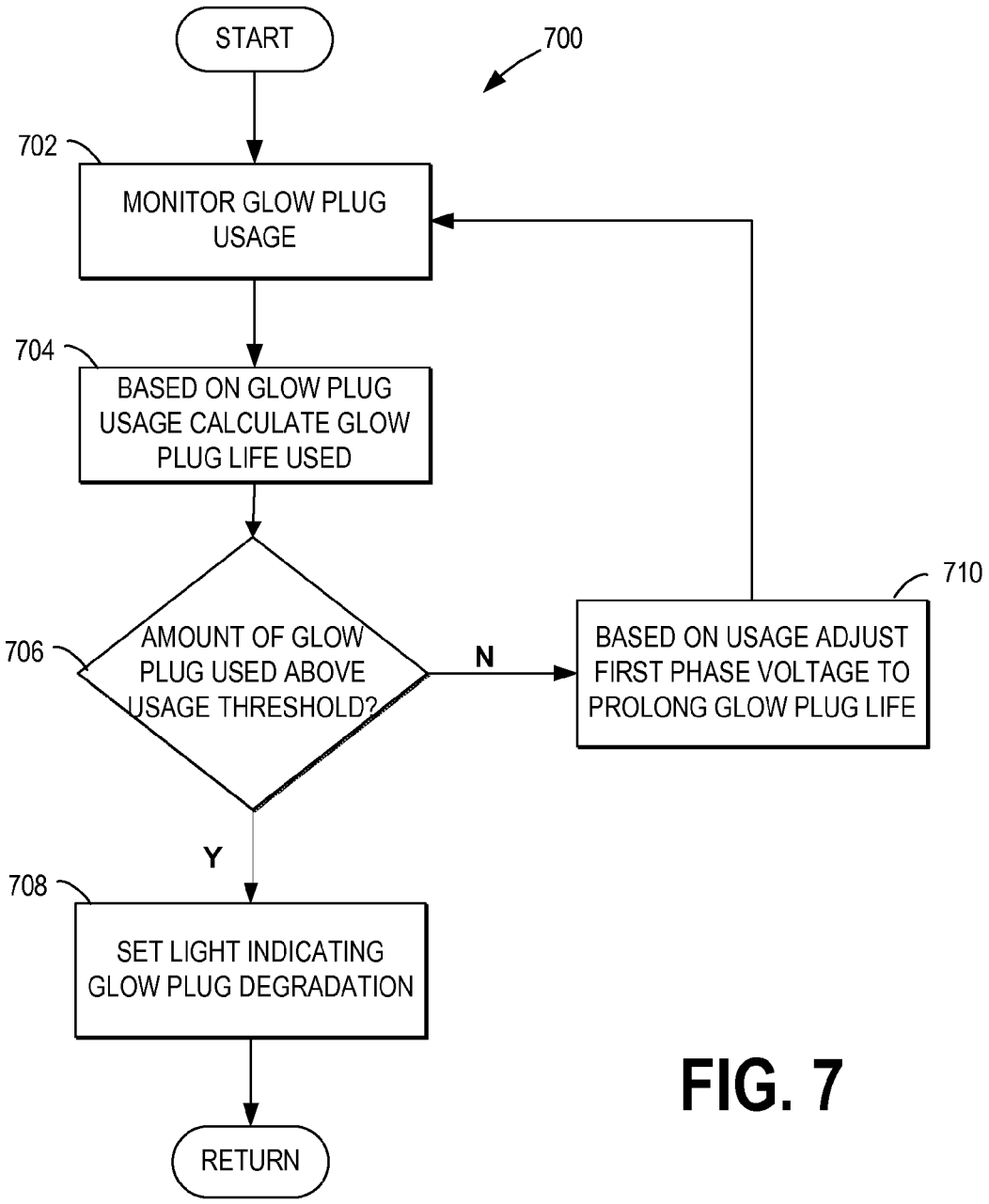
FIG. 7 is a flow-chart illustrating an example glow plug life calculator.

The present description is related to a method for starting a compression ignition diesel engine using an electrically heated glow plug to assist starting. In order to improve the durability of glow plugs and thereby prolong their useful life, the methods described include adjusting a first phase voltage based on an engine parameter associated with engine start time and further coupling it to a lower second phase voltage to achieve a desired temperature within an engine cylinder. For reference, FIG. 1 shows an example cylinder of a diesel engine with a glow plug. Then, to demonstrate the methods, FIGS. 2 and 3A-B show example thermal profiles for a reduced voltage and an increased voltage (e.g. 11 V) that is taken as the baseline profile. Example look-up tables are provided in FIGS. 4A-C that further demonstrates how a controller may access stored information to adjust voltages during engine start-up whereas FIGS. 5 and 6 provide example flow-charts to illustrate the method. Because glow plugs have a finite lifetime based on their usage, FIG. 7 shows an example method for monitoring said usage and making adjustments to prolong the useful life of the glow plug. Thereby, the methods described can be used to advantage in order to extend the useful life of a glow plug based on one or more engine parameters.

Referring to FIG. 1 that depicts an example embodiment of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (i.e. combustion chamber) 30 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 30 can receive intake air via a series of intake air passages 142, 144, and 146. Intake air passage 146 can communicate with other cylinders of engine 10 in addition to cylinder 30. In some embodiments, one or more of the intake passages may include a turbocharger including a compressor 52 arranged between intake air passages 142 and 144, and an exhaust turbine 54 arranged along exhaust passage 148. Compressor 52 may be at least partially powered by exhaust turbine 54 via shaft 56. In some embodiments, shaft 56 may be coupled to an electric motor to provide an electric boost, as needed. A throttle 62 including a throttle plate 164 may be provided along an intake passage of the engine for varying the flow rate and/or pressure of intake air provided to the engine cylinders. For example, throttle 62 may be disposed downstream of compressor 52, as shown, or may be alternatively provided upstream of compressor 52. In some examples, throttles may be disposed both upstream and downstream of compressor 52.

Exhaust passage 148 can receive exhaust gases from other cylinders of engine 10 in addition to cylinder 30. Exhaust gas sensor 126 is shown coupled to exhaust passage 148 upstream of emission control device 69. Sensor 126 may be any suitable sensor for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor. In some examples, sensor 126 may be coupled to the exhaust passage downstream of turbine 52 and emission control device 69. Emission control device 69 may be a three way catalyst (TWC), NOx trap, various other emission control devices, or combinations thereof. For example, emission control device 69 may include SCR catalyst 76 positioned downstream of turbine 54. SCR catalyst 76 may be configured to reduce exhaust NOx species to nitrogen upon reaction with reductant, such as ammonia or urea. Reductant injector 80 may inject reductant 82 into exhaust passage 148 upstream of turbine 54. Exhaust passage 148 may also include a particulate filter 72, positioned upstream of turbine 54 and injector 80, for removing particulate matter from exhaust gas.

Each cylinder of engine 10 may include one or more intake valves and one or more exhaust valves. For example, cylinder 30 is shown including at least one intake poppet valve 150 and at least one exhaust poppet valve 156 located at an upper region of cylinder 30. In some embodiments, each cylinder of engine 10, including cylinder 30, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type, cam actuation type, electro-hydraulic type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 30 may alternatively include an intake valve controlled via electric valve actuation, and an exhaust valve controlled via cam actuation including CPS and/or VCT. In other embodiments, the intake and exhaust valves may be controlled by a common valve actuator or actuation system, or a variable valve timing actuator or actuation system. The engine may further include a cam position sensor whose data may be merged with the crankshaft position sensor to determine an engine position and cam timing.

Cylinder 30 can have a compression ratio, which is the ratio of volumes when piston 138 is at bottom center to top center. Conventionally, the compression ratio is in the range of 9:1 to 10:1. However, in some examples where different fuels are used, the compression ratio may be increased.

As further described herein, each cylinder of engine 10 may include a glow plug 192 for initiating combustion. Ignition system 190 can provide a heating element to induce combustion within combustion chamber 30 via glow plug 192 in response to a signal from controller 12, under various operating modes described in detail below. A glow plug generates heat via a heating element that is directed into the cylinders creating a hot spot very near the fuel injector spray plume. Then, before starting the car, the vehicle is turned to the "on" position for a period of time while the glow plug is pre-heated to a minimum temperature conducive for combustion. Once the glow plug reaches a temperature threshold, or in some embodiments, once a time duration has elapsed, the wait to start light is turned off, signaling the driver that the conditions are right for ignition. Depending upon temperatures, the glow plugs remain on for several minutes after the wait to start light has been extinguished and the engine is started, which enhances combustion stability. In response, the operator may start the engine by turning the key to the start position to initiate combustion within the cylinder. Although glow plugs are generally used to start a vehicle's engine, if the engine is already warm, for instance, because the vehicle has been operated recently, the duration of time the engine is allowed to pre-heat may be reduced based on an elevated temperature therein. In other cases, the pre-heating step may be altogether omitted.

In some embodiments, each cylinder of engine 10 may be configured with one or more fuel injectors for providing fuel thereto. As a non-limiting example, cylinder 30 is shown including fuel injector 166 coupled directly to cylinder 30. Fuel injector 166 may inject fuel directly therein in proportion to the pulse width of signal FPW received from controller 12 via electronic driver 168. In this manner, fuel injector 166 provides what is known as direct injection (hereafter referred to as "DI") of fuel into combustion cylinder 30. While FIG. 1 shows injector 166 as a side injector, it may also be located overhead of the piston, such as near the position of glow plug 192. Alternatively, the injector may be located overhead and near the intake valve. Fuel may be delivered to fuel injector 166 from high pressure fuel system 172 including a fuel tank, fuel pumps, and a fuel rail. Alternatively, fuel may be delivered by a single stage fuel pump at lower pressure. Further, while not shown, the fuel tank may have a pressure transducer providing a signal to controller 12.

It will be appreciated that in an alternate embodiment, injector 166 may be a port injector providing fuel into the intake port upstream of cylinder 30. It will also be appreciated that cylinder 30 may receive fuel from a plurality of injectors, such as a plurality of port injectors, a plurality of direct injectors, or a combination thereof.

Controller 12 is shown in FIG. 1 as a microcomputer, including microprocessor 106, input/output ports 108, an electronic storage medium for executable programs and calibration values shown as read-only memory 110 in this particular example, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type, such as a crankshaft position sensor) coupled to crankshaft 140; throttle position (TP) from a throttle position sensor (not shown); and absolute manifold pressure signal (MAP) from sensor 124. Engine speed signal, RPM, may be generated by controller 12 from signal PIP (or the crankshaft position sensor). Manifold pressure signal MAP from a manifold pressure sensor may be used to provide an indication of vacuum, or pressure, in the intake manifold. Storage medium read-only memory 110 can be programmed with computer readable data representing instructions executable by microprocessor 106 for performing the methods described below as well as other variants that are anticipated but not specifically listed.

One or more exhaust gas recirculation (EGR) passages may route a desired portion of exhaust gas from exhaust passage 148 to intake passage 144. For example, a portion of exhaust gas that has been filtered through particulate filter 72 may be diverted to intake passage 144 via EGR passage 63. The amount of EGR flow provided to the intake may be varied by controller 12 via EGR valve 29. An EGR sensor (not shown) may be arranged within EGR passage 63 and may provide an indication of one or more of a pressure, temperature, and concentration of the exhaust gas. Under some conditions, the EGR system may be used to regulate the temperature of the air and fuel mixture within the combustion chamber, thus providing a method of controlling the timing of ignition during some combustion modes.

As described above, FIG. 1 shows only one cylinder of a multi-cylinder engine. As such, each cylinder may similarly include its own set of intake/exhaust valves, fuel injector(s), spark plug, etc.

In FIG. 2 example schematic glow plug temperature profiles for two different applied voltages are shown. Therein, temperature is plotted along the y-axis and temperature increases in the upward direction, and time is plotted along the x-axis and time increases from left to right. Baseline profile 202 shows that the glow plug tip temperature increases to a temperature threshold 206 in response to an applied voltage. Furthermore, the temperature threshold may be reached within a known period of time. For example, tests have shown that applying a voltage of 11.0 V to a ceramic glow plug may heat up the glow plug to target temperature 206 (e.g. 950° C.) in approximately 2 seconds. Alternatively, reduced voltage profile 204 shows that heating the glow plug at a lower voltage results in a longer duration of time to heat the glow plug up to target temperature 206. Example tests have shown that applying a voltage of 8.3 V to a ceramic glow plug results in the glow plug heating to target temperature 206 in approximately 5 seconds. As such, directly comparing the two curves shows a 3 second time difference, which is generally represented at 208. The methods described herein use this time difference to advantage by reducing the first phase voltage, also referred to as the push phase, while accepting the increase to the engine start time. Thereby, glow plug durability may be enhanced in order to prolong the useful life of the glow plug while reducing the potential for temperature overshoot.

In FIGS. 3A and B, example schematic glow plug voltage and heating profiles are shown to demonstrate the method. Two schematic plots are included in each figure. The top plot shows voltage plotted along the y-axis while the bottom plot shows glow plug tip temperature plotted along the y-axis. In both plots, the variable plotted on the y-axis increases in the upward direction. Each plot further shows time plotted along the x-axis, and time increases from left to right. For simplicity, only one x-axis is included in the lower plot. FIG. 3A shows a voltage and heating profile for the baseline curve (e.g. baseline curve 202) during one operational cycle of the engine start-up routine. Then, FIG. 3B shows a voltage and heating profile for a reduced push phase voltage (e.g. reduced voltage profile 204) to further demonstrate the methods. For clarity, and to allow for comparisons between the baseline and reduced voltage curves, the baseline curve of FIG. 3A is also shown in FIG. 3B.

With regard to the operational cycle of FIG. 3A, an amplitude of first phase voltage 302 is followed by a reduced amplitude of second phase voltage 304, also referred to as the glow phase, which in turn, is followed by substantially zero amplitude during cooling phase 306. Thus, during operation, the glow plug temperature profile shown in the lower plot also exhibits three general regions in response to the three different voltages applied. For instance, during the first phase a higher voltage may produce a quick increase in tip temperature as the glow plug is heated to a target temperature, as shown by heating rate 312. Therefore, the amplitude and time duration of the first phase voltage may be selected to achieve a desired glow plug temperature at the end of said time duration. Then, upon reaching the desired or target temperature, the first phase may be coupled to a lower second phase voltage supplied to the glow plug after the first phase voltage. During the second phase, the reduced voltage may be applied in order to hold the temperature of the glow plug constant for a desired period of time, as illustrated by constant temperature rate 314, while compression ignition is performed to start the engine. Finally, during the third phase, or cooling phase, which in one embodiment includes turning off the voltage applied so substantially no energy is supplied to the glow plug, the tip temperature may slowly decrease as the engine component cools down (e.g., shown by cooling rate 316). For example, baseline experiments have shown that a first phase voltage of 11.0 V applied for 2 seconds may be used to heat a ceramic glow plug to a temperature of 1200° C., whereas a second phase voltage of 5.6 V may be applied for 18 seconds followed by a third cooling phase of 0 V. As noted above, glow plug temperature profiles may depend on one or more engine parameters (e.g. ambient temperature), so the voltages applied and/or time duration of the phases may be adjusted based on various engine parameters detected.

Turning to FIG. 3B, according to the methods described herein, the first phase voltage may be reduced to prolong the life of a glow plug. For comparison, the baseline profile of FIG. 3A is also shown as a dashed line. Therein, the reduced first phase voltage 322 shows that although a lower voltage is applied to the glow plug, the target temperature may still be reached in the manner described above with respect to FIG. 2. Therefore, the time duration of the first phase is increased as the glow plug heats up more slowly and the reduced heating rate 332 has a lower slope compared to the heating rate of the baseline profile. For simplicity, and to demonstrate the effect of reducing the first phase voltage according to the method, the second phase voltage 324 and third phase voltage 326, as well as constant temperature rate 334 and cooling rate 336 are the same as the baseline profile. As such, the temperature profile of FIG. 3B is shifted after the first phase by the longer time duration due to the lower voltage applied. For example, experiments have shown that a reduced first phase voltage of 7.0 V applied for 4.2 seconds may be used to heat the ceramic glow plug to a temperature of 1200° C., which is followed by a second phase voltage of 5.6 V for 18 seconds and a third phase of 0 V. Furthermore, in example glow plug performance tests, the number of heating cycles performed according to the methods described was shown to be higher than the number of heating cycles performed by the baseline profile. Therefore, the glow plug lifetime may be increased when compared to the known methods. Further still, because the reduced first phase voltage 340 is coupled an increased first phase time duration 342, according to the method, the reduced first phase voltage may be adjusted in a known way to control the vehicle start time, or in an alternative embodiment described in greater detail below, it may be adjusted based on one or more engine parameters and an estimated amount of useful glow plug life remaining.

With respect to controlling the voltage supplied and the heating rate of a glow plug connected to a diesel engine, and starting of the engine based on one or more engine operating parameter, FIGS. 4A-C show examples of using glow phase temperature or voltage to determine a lower first phase voltage. Generally, look-up tables based on various parameters associated with engine start time may be used to determine the first phase voltage. For example, in one embodiment, controller 12 may be programmed with instructions to access data stored into look-up tables of read-only memory 110 based on one or more engine parameters. Therefore, FIGS. 4A-C shows example look-up tables selected from one or more of the following: temperature of the glow plug during said second phase voltage; or said second phase voltage; or engine temperature, respectively. Although three examples are provided for example, these are non-limiting and other examples may be possible.

As a first example, in FIG. 4A, the target temperature of the glow plug during the second phase is shown in table 402 as a function of engine temperature and post glow time. In general, a shorter post glow time at a given target temperature based on a colder engine temperature uses more energy and a higher voltage. As such, controller 12 may detect an engine temperature, for example, from a sensor coupled to cylinder 30 or from an engine coolant temperature. Then, to maintain a substantially constant glow phase temperature during the second phase of the cycle, table 404 shows that the glow phase voltage may be preselected based on the desired target temperature shown in table 402. For example, under cold start conditions where an engine temperature of −30° C. is detected, controller 12 may set a target temperature of 1200° C. based on a second phase duration, or glow phase time, of 30 seconds. Then, table 404 further shows that the targeted temperature may be reached in a desired time based on the heating rate and first phase voltage. Thus, once a target glow phase temperature has been identified, the first or push phase voltage, may be quickly by a computational device using table 404. To further continue the example, a glow phase temperature of 1200° C. may be achieved by applying a first phase voltage of 8 V for a time duration of 3.5 seconds as indicated in table 406. Therefore, because said first phase voltage is related to a desired time to commence starting the engine, the first phase voltage may be coupled to the glow plug for the preselected time indicated. In addition, because a relationship between the voltage applied to the glow plug and the tip temperature heating profile may be determined and programmed into memory, the first phase voltage may alternatively be reduced to conserve energy, and thereby conserve fuel, which increases start time duration but also prolongs the useful life of the glow plug. Although example numbers are provided, the tables vary depending on numerous factors including, for instance, the type of glow plug employed (e.g. metallic or ceramic), or other engine conditions. As such, other tables are also possible.

Alternatively, as a second example, in FIG. 4B, the tables may be based on the glow plug voltage during the second phase as shown in table 412. Therefore, in a similar manner as was described above with respect to the glow phase temperature, the glow phase voltage can be directly accessed by a controller, e.g. controller 12, based on an engine parameter. Thus, for the detected engine temperature of −30° C. described above, controller 12 may desire a glow phase voltage of 7 V based on a second phase duration of 30 seconds, which may also correspond to a glow phase temperature of 1200° C. Then, because the amplitude of the voltage in the second phase is reduced compared to the amplitude of the voltage in the first phase, look-up tables 404 and 406 may further be used to adjust a first phase voltage to 8 V for 3.5 seconds in order to reach the target temperature.

As a third example, in FIG. 4C, the first phase voltage and time duration may be determined directly from a measurement of the engine temperature. Therefore, look-up table 422 may simply relate the first phase voltage to an engine temperature so controller 12 may adjust the first phase voltage supplied from a temperature measurement within the engine system. Furthermore, as indicated in table 406, which is again reproduced for clarity, controller 12 may supply the first phase voltage for a period of time based on the temperature measured. As such, in all three examples, the second phase voltage is supplied at a predetermined amplitude and for a preselected time to commence starting the engine.

Turning to control of the methods, FIGS. 5 and 6 show flow-charts illustrating two example methods for adjusting glow plug voltages during engine start-up.

In FIG. 5, method 500 illustrates an example method for determining the first phase voltage based on one or more engine operating parameters. Therein, at 502 method 500 includes determining an engine temperature, for instance by measuring a coolant temperature or a temperature within an engine cylinder. Then, if the engine is above a threshold, for example because the vehicle has been operated recently and is already warm, or because the ambient temperature is warm (e.g. greater than 20° C.), at 504, method 500 includes starting the vehicle by turning the key to the "on" position and further igniting the compressed cylinder charge as shown at 506.

Alternatively, if at 502, the engine temperature falls below the temperature threshold, at 510, controller 12 may determine one or more engine parameters before commencing engine ignition. For instance, controller 12 may measure an engine coolant temperature in order to set a voltage supplied to the glow plugs as described above with respect to FIGS. 4A-C. Then, at 512, controller 12 may further adjust the first phase voltage based on the temperature measured. Therefore, according to the methods described, a reduced push phase voltage may be supplied for a longer period of time. As such, in one embodiment, controller 12 may be programmed to determine the optimal first phase voltage that substantially minimizes glow plug degradation over time. Based on the voltage set by controller 12, at 514, method 500 includes turning on the dashboard light, which may be a wait to start lamp on the instrument panel. This light indicates to a vehicle occupant that the glow plug is being heated and further instructs the occupant to wait until the tip temperature reaches a temperature threshold, as shown at 516, before attempting to start the engine. Then, once the glow plug temperature has reached a temperature threshold, method 500 includes starting the vehicle by turning the key to the "on" position, which may further ignite the compressed cylinder charge.

Alternatively, in FIG. 6, method 600 illustrates a second example wherein the first phase voltage is calculated based on a targeted start time. Therefore, according to this method, a first phase voltage may be selected based on a desired time duration of the first phase, which may also be coupled to a measured engine temperature.

At 602, method 600 includes identifying a target ignition or first phase time. As such, in one embodiment, a start time may be identified and a voltage set based on the desired start time indicated. In response, controller 12 may determine that a quicker start time is acceptable and adjust voltages accordingly to meet the identified start time. Therefore, at 604, method 600 includes calculating first or second phase voltages to achieve the start time identified. For example, to achieve a start time of 2 seconds, which in this example is the time duration of the first phase, controller 12 may determine that a higher first phase voltage (e.g. 11 V) is to be applied to reach the target temperature more quickly. Alternatively, if controller 12 determines that a lower voltage may be applied to reach the target threshold, then the voltage may be reduced using the methods described wherein the amplitude and time duration of the first phase voltage are selected to achieve a desired glow plug temperature at the end of a desired time duration. Therefore, according the method described, the time to commence starting of the engine may be controlled in relation to a first phase voltage amplitude and time duration where the preselected time may generally relate to one or more of the following: temperature of the glow plug during said second phase voltage; or said second phase voltage; or engine temperature.

Continuing with the description of method 600, at 606, controller 12 may adjust a voltage and turn on the wait to start lamp to indicate to a vehicle occupant that a glow plug is being heated. Thus, at 608, method 600 includes waiting until the temperature of the glow plug has reached a target threshold before commencing the ignition process. Then, once the glow plug temperature has reached a target, or threshold temperature, method 600 further includes starting the vehicle by turning the key to the "on" position at 610, which commences the starting of the engine ignition process. The time to commence starting the engine may be indicated on a dashboard light, or in some embodiments, the time to commence starting the engine may initiate an automatic engine start.

With respect to a method for prolonging the useful lifetime of a glow plug, FIG. 7 shows method 700 that relates to a glow plug calculator and control. The method may be useful for controlling the voltage supplied to a glow plug within a diesel engine based on past operating conditions. In general, the method comprises indicating degradation of the glow plug in response to one or more past operating conditions that relate to glow plug aging and further controlling voltages applied to the glow plug in response to said indications in order to prolong the useful life of the glow plug. Then, once the amount of glow plug used exceeds a usage threshold, method 700 further includes indicating degradation of a glow plug so the engine system can be serviced and glow plugs replaced.

As such, at 702, method 700 includes monitoring glow plug usage. For instance, controller 12 may be programmed to track voltages applied and the time duration of voltages applied over the life of the glow plug. Therefore, characteristics of glow plug usage (e.g. phase time or temperature) may be compiled over many operational starting cycles and stored into memory for use by the engine system.

At 704, method 700 further includes calculating the amount of glow plug life used based on the data compiled and stored within the system. For example, an instant start ceramic glow plug may have a durability of 10 years with 35,000 cycles. As such, the number of cycles performed may provide an indication as to the state of condition of the glow plugs. Therefore, in one embodiment, method 700 can tabulate and process the number of cycles performed to estimate the amount of useful glow plug life that has been expended. Then, at 706, method 700 further includes comparing the calculated amount of glow plug life used to a usage threshold and setting a dashboard light at 708 indicating glow plug degradation if the calculated amount of life used exceeds the usage threshold. Thereby, degradation of the glow plug may be indicated in response to one or more past operating conditions related to glow plug aging. As another example, the usage threshold may be based on a degradation indicator that is a scalar multiple of the look-up tables shown in FIG. 4A-C. For instance, if the first phase heating duration is longer than that expected based on the various times shown in table 406 (e.g. 20% longer), then degradation of the glow plug may be indicated accordingly. Alternatively, in still another example, the degradation indicator may detect starting times whose duration is longer than the look-up tables shown in FIG. 4A-C by an offset. Therefore, degradation may be indicated, for instance, when the various times in table 406 are consistently longer than the example values shown by a substantially constant additional value (e.g. first phase heating times longer by 1 second).

Alternatively, if the calculated amount of glow plug life used falls below the usage threshold, at 710, method 700 includes adjusting one or more of the first and second phase voltages delivered to a glow plug based on the past operating conditions to prolong the useful life of the glow plug. For instance, both amplitude of said first phase voltage coupled to the glow plug and time duration of said first phase voltage in relation to one or more parameters associated with engine start time to achieve a desired glow plug temperature at the end of said first phase voltage time duration may be controlled in response to one or more engine conditions. Furthermore, a reduced second phase voltage may be coupled to the glow plug after said first phase voltage time duration for a predetermined time which is longer than said first phase voltage time duration and at a predetermined voltage which is lower than said first phase voltage amplitude to further raise said glow plug temperature in the manner already described. Thereby, the time to commence starting of the diesel engine may be controlled to extend the useful life of the glow plug. As also described above, the first phase voltage may be further controlled based on a parameter associated with engine start time.

The first phase voltage that is used to quickly heat up the glow plug is commonly known to be the hardest phase of the operational cycle on glow plug durability. As one example, controller 12 may monitor usage of one or more glow plugs within the engine system and adjust a voltage based on the number of previous engine starts. Therefore, in response to a high number of previous engine starts (e.g. >25,000 starts for the instant start ceramic plug above), the amplitude of the voltage supplied to the glow plug may be reduced during the first phase to prolong the useful glow plug life. Therefore, by reducing the first phase voltage and extending the time duration of the first phase, for example, from 2 seconds to 5 or 6 seconds, or longer, the lifetime of the glow plug may be prolonged. As another example, the heating rate of metallic glow plugs is less than the heating rate of ceramic glow plugs. As such, metallic glow plugs take longer to heat up to a target temperature compared to ceramic glow plugs (e.g. 3 seconds compared to 2 seconds for ceramic glow plugs). In addition, metallic glow plugs have a lower durability life (e.g. 10 years and 15,000 cycles). Based on the lower durability, a lower number of start cycles may be relied on to indicate glow plug aging when metallic glow plugs are used, which controller 12 may be programmed to account for.

This concludes the Detailed Description, the reading of which provides advantageous methods for enhancing glow plug usage. The methods described may result from adjusting a first phase voltage based on one or more engine parameters. Thereby, glow plug durability may be enhanced in order to prolong the useful life of the glow plug.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for controlling temperature of a glow plug connected to a diesel engine, comprising:

adjusting an amplitude of a first phase voltage coupled to the glow plug during a push phase and a time duration of said first phase voltage based on a targeted temperature for a glow phase following the push phase and a number of previous engine start cycles.

2. The method recited in claim 1, further comprising coupling a lower second phase voltage to the glow plug during the glow phase, wherein the targeted temperature for the glow phase is determined based on engine temperature, and wherein during the push phase, the glow plug is heated to the targeted temperature via application of the first phase voltage.

3. The method recited in claim 1, wherein said targeted temperature for the glow phase is determined based on engine temperature and a desired glow phase duration.

4. The method recited in claim 1, wherein adjusting the amplitude of said first phase voltage and the time duration of said first phase voltage based on said number of previous engine start cycles comprises decreasing the amplitude of said first phase voltage and increasing the time duration of said first phase voltage when said number of previous engine start cycles is greater than a threshold.

5. The method recited in claim 2, wherein the adjustment of the amplitude of the first phase voltage and the time duration of the first phase voltage is further based on said second phase voltage and engine temperature.

6. The method recited in claim 1, wherein said adjustment of the first phase voltage and the time duration of the first phase voltage is further based on a desired time to commence starting the engine.

7. The method recited in claim 1, wherein the adjustment of the amplitude and time duration of the first phase voltage is further based on a value stored in a look-up table which corresponds to the targeted temperature for the glow phase.

8. A method for controlling temperature of a glow plug connected to a diesel engine and starting of the engine, comprising:

if a number of previous engine start cycles is below a threshold, applying a first voltage to the glow plug during a push phase for a first duration; and if the number of previous engine start cycles is above the threshold, applying a second voltage lower than the first voltage to the glow plug during the push phase for a second duration longer than the first duration.

9. The method recited in claim 8, further comprising coupling a third voltage to the glow plug during a glow phase following the push phase, the third voltage lower than the voltage applied to the glow plug during the push phase.

10. The method recited in claim 9, wherein a time to commence engine starting is related to an amplitude of the voltage applied to the glow plug during the push phase.

11. The method recited in claim 9, wherein said glow plug is a metallic glow plug.

12. The method recited in claim 11, wherein the temperature of said glow plug is controlled to be less than 1200° C.

13. A method for controlling temperature of a glow plug connected to a diesel engine of a vehicle and starting of the engine, comprising:

monitoring characteristics of glow plug usage over a plurality of engine starting cycles and storing the characteristics in memory of a control system of the vehicle;

adjusting both an amplitude of a first phase voltage coupled to the glow plug and a time duration of said first phase voltage based on the stored characteristics, coupling said first phase voltage to the glow plug, and turning on a wait to start lamp on a dashboard of the vehicle; and signaling a driver of the vehicle that conditions are right for ignition once the time duration has elapsed by turning off the wait to start lamp.

14. The method recited in claim 13, further comprising initiating an automatic engine start once the desired time duration has elapsed.

15. The method recited in claim 13, wherein the amplitude of the first phase voltage is further adjusted based on a value stored in a look-up table which corresponds to engine temperature.

16. The method recited in claim 1, further comprising:

during the push phase, turning on a wait to start lamp on a dashboard of a vehicle; and once the time duration has elapsed, signaling a driver of the vehicle that conditions are right for ignition by turning off the wait to start lamp, and coupling a lower second phase voltage to the glow plug during the glow phase.

17. The method recited in claim 1, further comprising:

once the time duration has elapsed, automatically starting the engine.

18. The method recited in claim 1, further comprising estimating an amount of glow plug life that has been expended based on the number of previous engine start cycles, and setting a dashboard light of a vehicle indicating glow plug degradation if the estimated amount of glow plug life that has been expended exceeds a usage threshold.

19. The method recited in claim 13, wherein monitoring the characteristics of glow plug usage over the plurality of engine starting cycles comprises tracking voltages applied to the glow plug and a time duration of the voltages applied to the glow plug over a life of the glow plug.

* * * * *